US006554212B2

(12) United States Patent
Borcea et al.

(10) Patent No.: US 6,554,212 B2
(45) Date of Patent: Apr. 29, 2003

(54) ROBOT SPRAY HEAD FOR CAVITY TREATMENT

(75) Inventors: Nicky Borcea, Weston, CT (US); Fredy Doll, Achem (DE)

(73) Assignee: IPR Automation LP, Weston, CT (US)

( * ) Notice: Subject to any disclaimer, the term of this patent is extended or adjusted under 35 U.S.C. 154(b) by 0 days.

(21) Appl. No.: 09/779,274

(22) Filed: Feb. 8, 2001

(65) Prior Publication Data

US 2002/0104900 A1 Aug. 8, 2002

(51) Int. Cl.[7] ..... A62C 31/02

(52) U.S. Cl. ..... 239/391; 239/393; 239/304; 239/307; 239/587.2

(58) Field of Search ..... 239/390, 391, 239/393, 395, 397, 587.1, 587.2, 587.5, 304, 305, 307, 407, 106, 112; 74/109, 32, 33; 901/43, 49

(56) References Cited

U.S. PATENT DOCUMENTS 4,561,592 A 12/1985 Fender et al.
4,635,328 A * 1/1987 Palmer ..... 901/43
4,679,734 A 7/1987 Mommsen et al.
4,697,741 A * 10/1987 Dengler et al. ..... 239/391
4,785,760 A * 11/1988 Tholone ..... 239/587.1
4,798,341 A 1/1989 Gimple
5,271,953 A * 12/1993 Litteral ..... 427/8
5,796,229 A * 8/1998 Akeel ..... 901/49
5,887,800 A 3/1999 McClosky

FOREIGN PATENT DOCUMENTS

DE 3616235 A1 11/1987

* cited by examiner

*Primary Examiner*—Michael Powell Buiz
*Assistant Examiner*—Dinh Q. Nguyen
(74) *Attorney, Agent, or Firm*—Fattibene & Fattibene; Paul A. Fattibene; Arthur T. Fattibene

(57) ABSTRACT

A spray head assembly for attaching to an industrial robot having an overload protection device coupled to a changer with an attached spray head body with a common nozzle supply and a plurality of nozzles selectively attached to the common nozzle supply. Each of the plurality of nozzles is selectively rotated into position and may provide a different spray pattern depending upon the application. The spray head assembly is compact and suited to working in tight spaces, and in particular spraying the interior of cavities. The present invention is particularly applicable to applying an anticorrosion wax to the inside of automobile or car body cavities.

15 Claims, 5 Drawing Sheets

ROBOT SPRAY HEAD FOR CAVITY TREATMENT

FIELD OF THE INVENTION

The present invention relates in general to industrial automation, and more particularly to a spray head used on an industrial robot for providing an anticorrosion wax to the inside of cavities.

BACKGROUND OF THE INVENTION

It is desirable to automate many manual tasks. This is particularly true in situations where a hazardous environment may result. In applying materials by spraying, often conditions are not suitable for a human operator. Therefore, when a human operator is required to operate spraying equipment, protective gear must be used. Accordingly, robotic equipment has been used in many spray applications. For example, a spray gun is disclosed in U.S. Pat. No. 4,798,341 entitled "Spray Gun For Robot Mounting" issuing to Gimple on Jan. 17, 1989. Therein disclosed is a spray gun for mounting on a programmable industrial robot. A spray head is remotely attached to a manifold. A remotely controlled regulator is located in the manifold liquid passage and a remote controlled valve is located in the manifold forward return passage. Pattern shaping air control valves are located in the manifold passage. Another spray gun is disclosed in U.S. Pat. No. 4,679,734 entitled "Robot Spray Gun" issuing to Mommsen et al on Jul. 14, 1987. Therein disclosed is a spray gun mounted on the end of a robot arm. The main components of the spray gun are located in the main body to which is mounted a pivotal spray head assembly. Another spray head is disclosed in U.S. Pat. No. 4,561,592 entitled "Robot Spray Head" and issuing to Fender et al on Dec. 31, 1985. Therein disclosed is an apparatus for controlling paint spraying nozzles to provide additional degrees of freedom of spray direction.

While these prior spray guns have all improved the automation of spraying, they are often relatively large and cannot easily access small cavities or spaces, or provide a desirable spray pattern in many applications. In applications involving tight spaces or spraying inside cavities, manual operation is still often needed. The manual operator often better reacts to a collision between the part being sprayed and the spray head. The manual operator is also often able to modify or alter the spray pattern depending upon the situation. This often provides better spray coverage than is possible using conventional robotic spray guns. Therefore, there is a need for an improved spray gun or head that can access tight spaces and cavities without damage due to collisions, as well as provide a flexible spray pattern.

SUMMARY OF THE INVENTION

The present invention provides a spray head attached to a robotic arm providing improved spraying in tight spaces and cavities. The present invention comprises a spray head attached to a robotic arm having overload protection. A mixing valve is associated with the spray head and has a common supply. A plurality of nozzles are rotatably connected to the spray head and selectively rotated into position on the common supply. A changer is positioned between the overload protection and the spray head so that different spray heads may be mounted. The plurality of nozzles provide different spray patterns for different applications providing improved coverage.

Accordingly, it is an object of the present invention to provide a spray gun capable of automating the spraying of cavities and other tight spaces.

It is a further object of the present invention to reduce the need for human operator control.

It is a further object of the present invention to substantially reduce the amount of wax used during spraying.

It is an advantage of the present invention that it is easily reset after a collision.

It is a further advantage of the present invention that it is relatively small and compact.

It is yet a further advantage of the present invention that an improved spray pattern and uniformity is achieved.

It is yet a further advantage of the present invention that it is easily cleaned.

It is a feature of the present invention that overload protection is provided in the event of a collision.

It is another feature of the present invention that a plurality of different nozzles may be rotated quickly into position.

It is yet a further feature of the present invention that a mixing valve is associated with the spray head.

It is yet a further feature of the present invention that a cleaner solution is selectively provided to the mixing valve.

These and other objects, advantages, and features will become readily apparent in view of the following more detailed description.

DETAILED DESCRIPTION OF THE PREFERRED EMBODIMENTS

Figure 1:
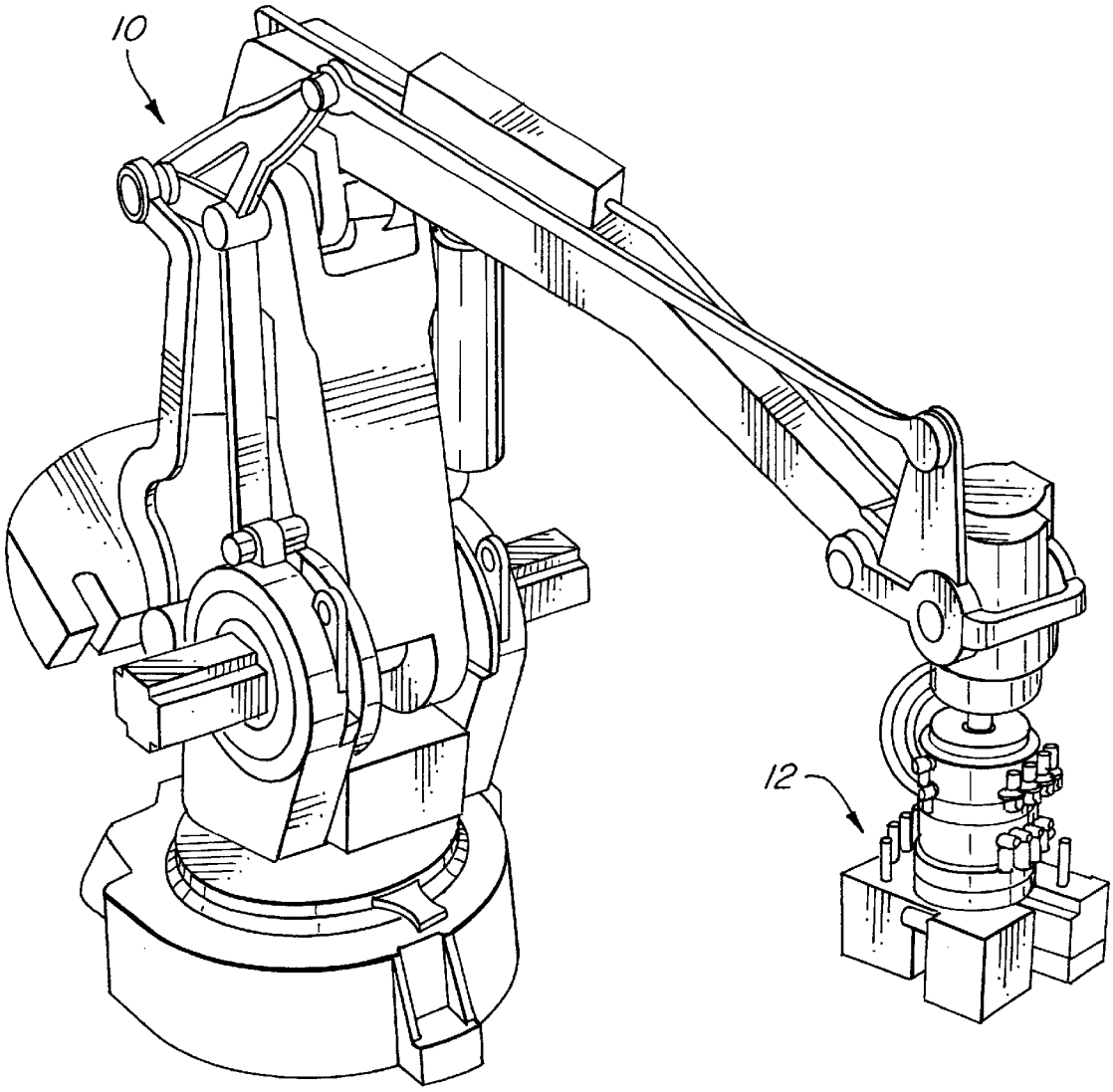
FIG. 1 schematically illustrates the present invention attached to a robot arm.

FIG. 1 schematically illustrates an industrial robot 10 with a spray head assembly 12 attached thereto. The spray head assembly 12 of the present invention may be attached to a variety of different industrial robots. The industrial robot 10 illustrates a general type of industrial robot with which the present invention may be used. The spray head assembly 12 of the present invention is particularly well suited for use in automobile manufacturing. In the manufacture of automobiles it is often required to spray tight spaces or the inside of cavities with an anticorrosive wax. A preferred application of the present invention is therefore in the automotive industry.

Figure 2:
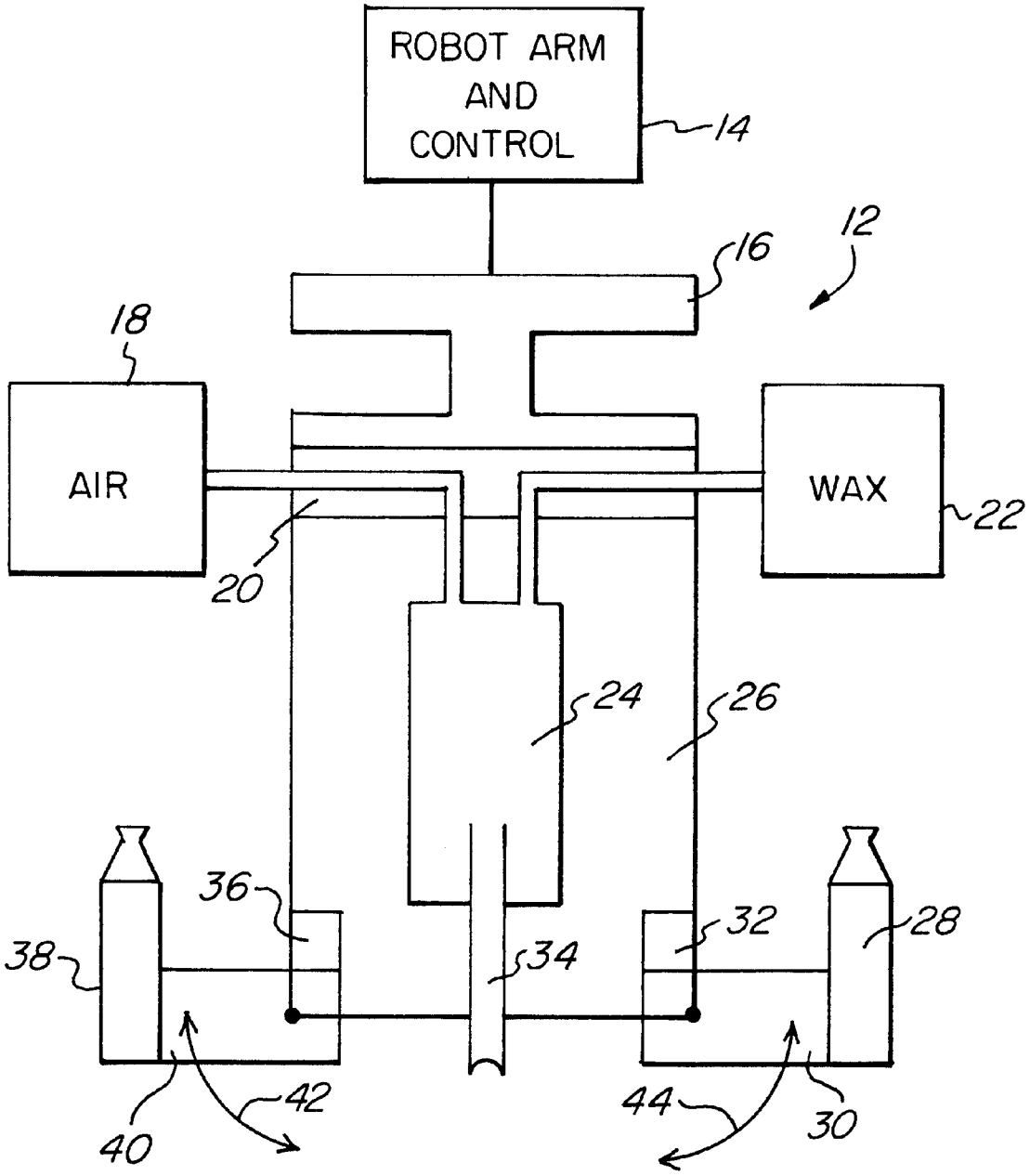
FIG. 2 schematically illustrates a spray head of the present invention.

FIG. 2 schematically illustrates the spray head assembly 12 of the present invention. Box 14 represents the robot arm and control system of an industrial robot. The spray head assembly 12 is coupled to the robot arm and control 14 by an overload device 16. The overload device 16 in turn is connected to a hand exchange device or changer 20. The hand exchange device or changer 20 is coupled to a spray head body 26. A mixing valve 24 is associated with the spray head body 26 and receives air from air supply 18 and wax from an anticorrosion wax supply 22. At one end of the mixing valve 24 is a common nozzle supply 34. On an end of the spray head body 26, adjacent the common nozzle supply 34, are positioned a plurality of nozzles 28 and 38. A first nozzle 28 is attached to a first rotating arm 30. The rotating arm 30 is driven by a first drive 32. Similarly, a second nozzle 38 is connected to a second rotating arm 40 and driven by second drive 36. The first and second nozzles 28 and 38 are rotated in the direction of arrows 42 and 44 respectively. Accordingly, the nozzles 28 and 38 are selectively coupled to the common nozzle supply 34. While only two nozzles 28 and 38 are shown for illustration purposes, clearly one, two, three, four, or other number of nozzles may be used. Preferably, the nozzles 28 and 38 are radially positioned around the common nozzle supply 34. Each different nozzle provides a different spray pattern adapted to a particular need or situation. The robot arm and control 14 communicates with the first and second drives 32 and 36 to selectively rotate a selected nozzle 28 or 38 into position.

In operation, the overload device 16 functions to loosen the attachment to the hand exchange device 20 should the spray head assembly 12 have a collision or hit a part being sprayed. This prevents damage from occurring to the part collided with or the spray head assembly 12. This permits the spray head assembly 12 of the present invention to maneuver in tight spaces and cavities with little risk of damage. Air and anticorrosion wax are mixed in mixing valve 24. The air supply 18 and the wax supply 22 are illustrated as being provided through the changer 20. However, clearly the air supply 18 and the wax supply 22 may be provided by other means, such as through the spray head body 26. After the air and wax are mixed in the mixing chamber 24, the mixture to be sprayed is provided to the common nozzle supply 34. A selected nozzle 28 or 38 is rotated into position and coupled with the common nozzle supply 34. One of a plurality of nozzles 28 or 38 may be selected, depending upon the application and spray pattern desired. The selection of a spray nozzle 28 or 38 can be made quickly and automatically, and in many situations without repositioning the spray head assembly 12. This greatly saves time. The drive 32 and 36 may utilize a rotary actuator or rack and pinion activation, or any other equivalent drive means.

The present invention is particularly adapted to the application of an anticorrosion wax treatment to the inside of car body cavities. The anticorrosion wax is often over sprayed in prior spray systems due to the lack of adjustability of the spray pattern and inaccessibility in small areas. Therefore, the present invention results in significant savings in both time and material. The present invention uses less wax and provides better quality and faster cycle times. To reach into tight spaces in car body cavities, different robots may be utilized, each with a plurality of specialized nozzles. A family of spray head assemblies may be utilized having one, two, or four nozzles. As a result, the number of robots needed may be reduced, but yet provide for the needs of anticorrosion wax spraying for the automobile industry. Accordingly, the substantial capital investment in robots may be reduced.

Figure 3:
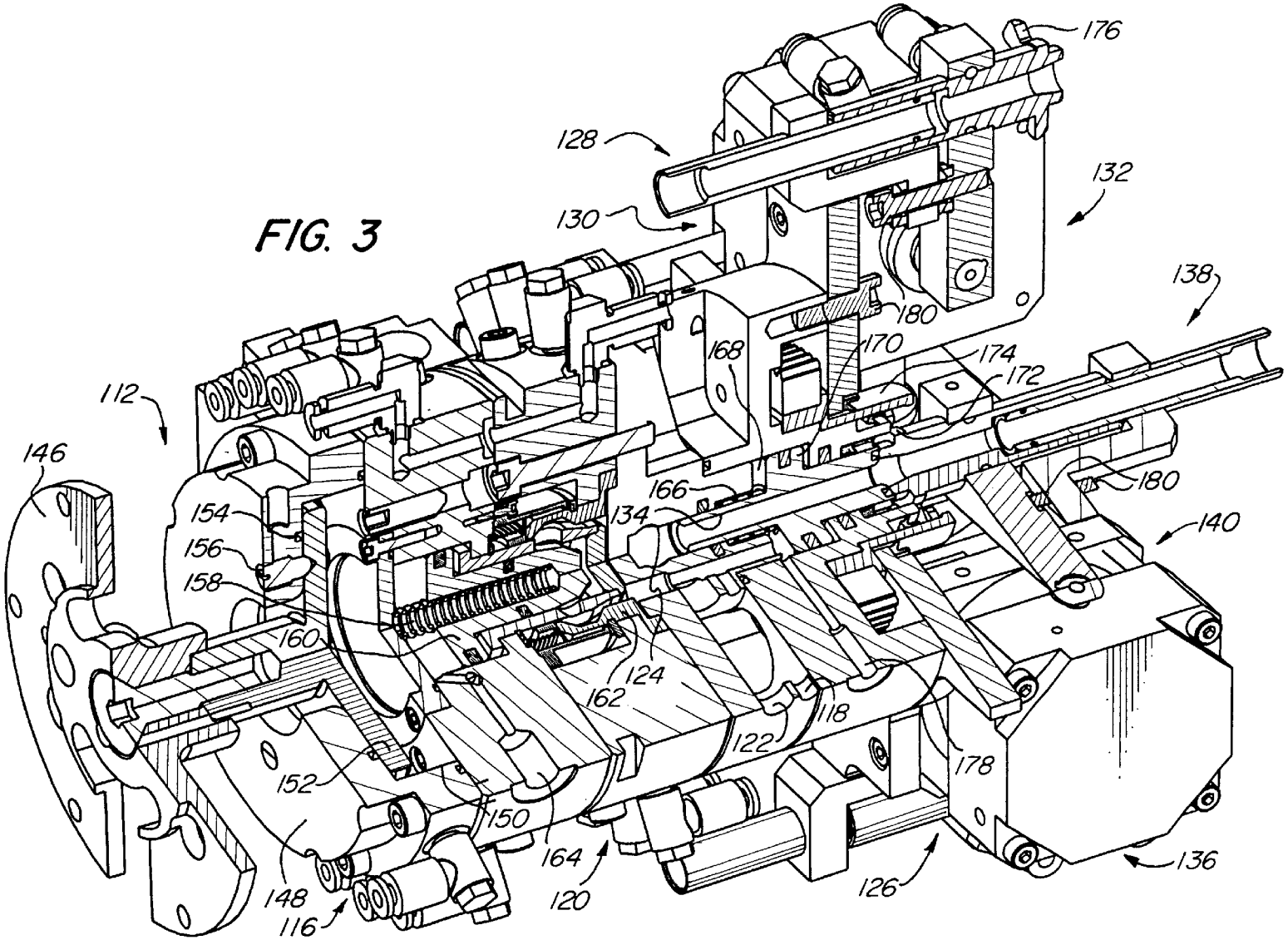
FIG. 3 is a sectioned view of a spray head of the present invention.

FIG. 3 is a partial section illustrating an embodiment of the present invention. Spray head assembly 112 is comprised of three primary sections. The first section is an overload device 116. The second section is a hand exchange device or changer 120. The third section is a spray head body 126.

The overload device 116 releases the hand exchange device or changer 120 in the event of a collision. A mounting plate 146 is adapted to be mounted onto the arm of an industrial robot. A cylinder housing 148 is attached to the mounting plate 146. The cylinder housing 148 has a cylinder 150. Within cylinder 150 is placed a piston 152. The piston 152 has associated therewith seals 154. A locator 156 helps to locate the piston 152. The overload protection device 116 is coupled to the hand exchange device or changer 120.

In operation, should the spray head assembly strike an unintended object, the overload protection device 116 prevents damage to the spray head assembly 112. Should a collision occur, the piston 152 breaks away from the cylinder housing 148, permitting the changer 120 and the spray head body 126 to be loosely held. The spray head assembly 112 is easily reset by repositioning the piston 152 with the aid of the locator 156. Air pressure within the cylinder 150 provides a rigid yet releasable coupling. The changer 120 includes a safety spring 158 coupled to a hand locking piston 160. The hand locking piston 160 is placed within a cylinder and can be activated with an air supply provided through the hand locking supply 164. The hand locking piston 160 is coupled to a hand locking receiver 162 attached to the spray head body 126. The hand locking piston 160 may have associated therewith a ball that moves radially outward to securely attach to the hand locking receiver 162. The hand exchange device or changer 120 permits the spray head body 126 to be changed quickly and accurately with other attachments or other different spray head bodies. The safety spring 158 assures that the changer 120 maintains coupling with the spray head body 126, even if an air supply is inadvertently interrupted or not available.

The spray head body 126 includes a mixing valve located in a chamber 124. Air supply inlet 118 and an anticorrosion wax supply inlet 122 supply the chamber 124. Coupled to the mixing valve chamber 124 is a common nozzle supply 134. A nozzle 138 is shown coupled to the common nozzle supply 134. Stops 180 help to position the rotating arm 140. Rotating arm 140 is rotated into position by drive 136. Drive 136 may be a rotary actuator or a rack and pinion type actuator, or equivalent. Similarly, nozzle 128 is illustrated in an inactive position and rotated out of the way on arm 130. Drive 132 moves arm 130 in and out of position. When the drive 132 positions the arm 130 and nozzle 128, stops 180 help to accurately position the nozzle 128 onto the common nozzle supply 134. To aid in coupling the nozzle supply 134 to a nozzle 138 or 128, bayonet attachments 172 and 176 are utilized. As illustrated on nozzle 138, the nozzle bayonet lock 174 locks the bayonet attachment 172 into position. The nozzle bayonet lock 174 may be rotated by a drive. To assist in sealing between the common nozzle supply 134 and the selected nozzle 138 or 128, the common nozzle supply 134 may be moved axially. The axial movement of common nozzle supply 134 is assisted by spring 166 and nozzle sealing cylinder 168, in combination with nozzle sealing piston 170. Nozzle locking opening 178 supplies activating air pressure to the nozzle sealing piston 170.

Figure 4:
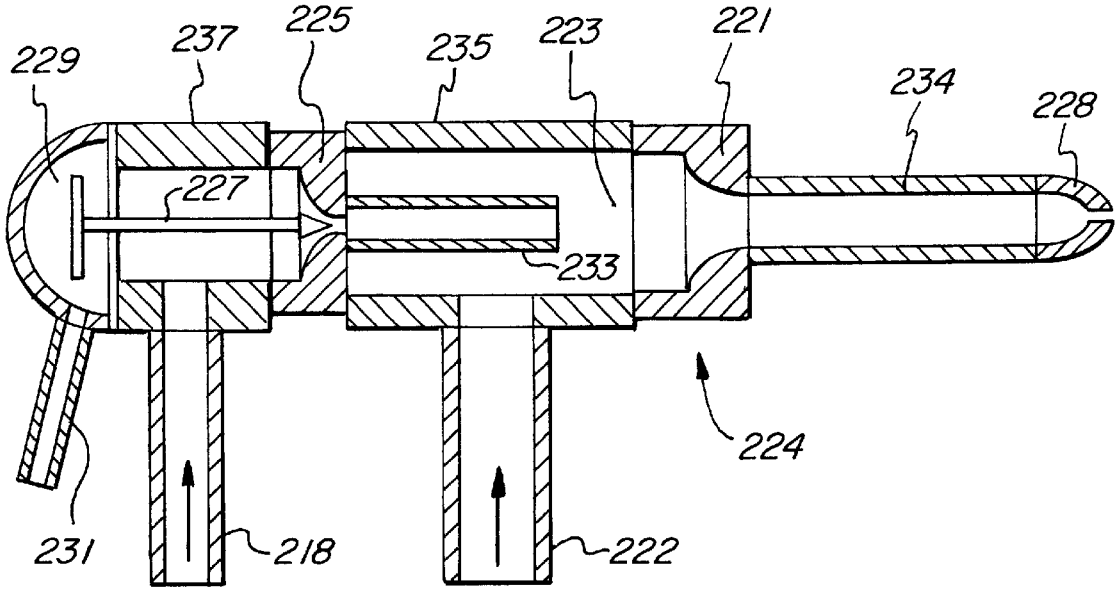
FIG. 4 schematically illustrates a mixing valve.

FIG. 4 illustrates a mixing valve 224 that may be utilized within the mixing valve chamber 124 in the embodiment illustrated in FIG. 3. However, the mixing valve may also be located on the body of the spray head assembly. The mixing valve 224 has a nozzle 228 connected to a nozzle supply 234. The nozzle supply 234 interfaces with a nozzle transition body 221 in the mixing chamber 223. The mixing chamber 223 is formed within the mixing valve chamber body 235. The mixing valve chamber body 235 is connected to a needle valve seat 225. The needle valve seat 225 is coupled to the needle valve body 237. Within the needle valve body 237 is a needle valve 227. A needle valve adjusting chamber 229 is formed adjacent the needle valve body 237 and has a needle valve adjustment supply line 231 coupled thereto. The needle valve body 237 has an air supply line 218. The mixing valve chamber body 235 has a wax supply line 222. A shield 233 is also provided within the mixing chamber 223. The mixing valve 224 provides automated adjustment and thorough mixing of an anticorrosion wax for spraying. The air supply provided by air supply line 218 is adjusted by the needle valve 227. The needle valve 227 is kept clean by shield 233 and the supply of clean air. Adjustments to the needle valve 227 may be made automatically, utilizing needle valve adjustment supply line 231 and a piston attached to the end of the needle valve 227.

Figure 5:
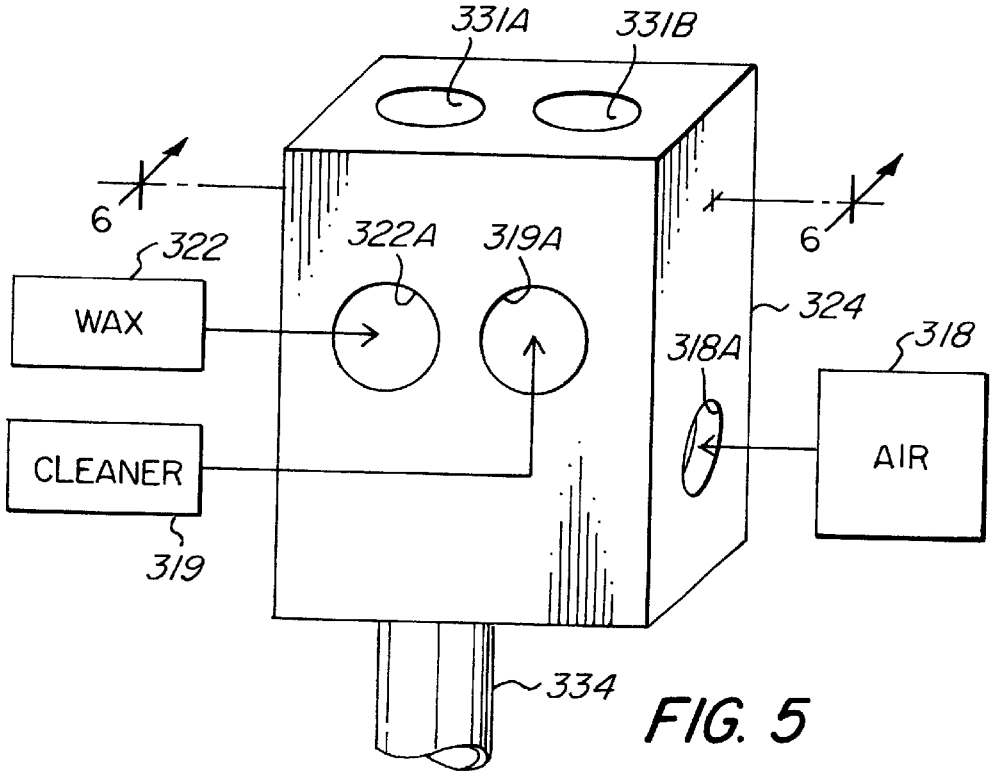
FIG. 5 schematically illustrates another embodiment of a mixing valve.

FIG. 5 schematically illustrates another embodiment of a mixing valve. This embodiment of the mixing valve may be placed on the exterior of the spray head or incorporated internally. A mixing valve body 324 has a plurality of supply ports. Wax 322 is supplied to a wax supply port 322A, and air 318 is supplied to an air supply port 318A. A cleaning fluid or cleaner 319 is supplied to cleaner supply port 319A. Valve access ports 331A and 331B correspond to the wax supply port 322A and cleaner supply port 319A, respectfully. After mixing, the wax anticorrosion treatment is provided to the spray nozzles through nozzle supply 334.

Figure 6:
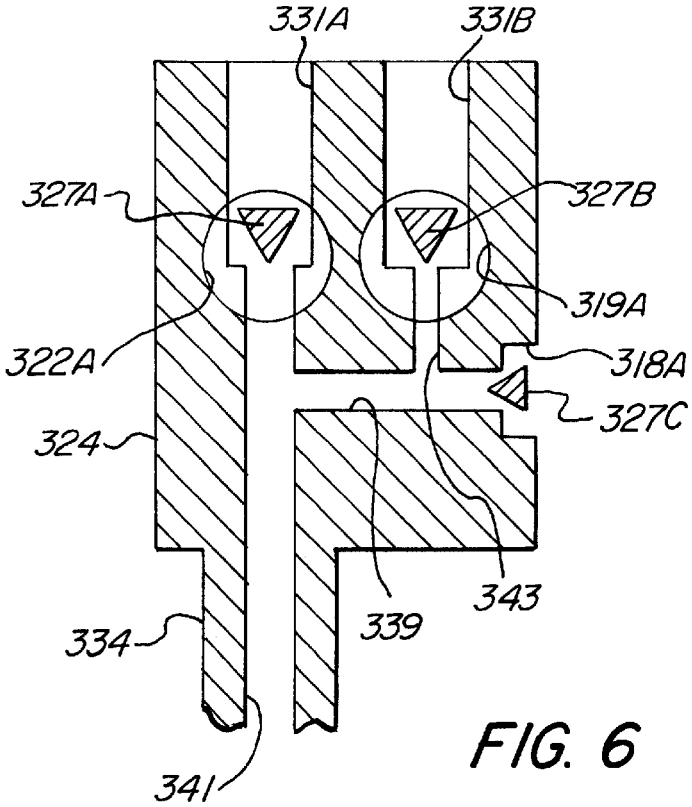
FIG. 6 is a cross section taken along line 6—6 in FIG. 5.

FIG. 6 is a cross section taken along line 6—6 and schematically illustrates the internal configuration of the mixing valve body 324. Valve access ports 331A and 331B provide access for adjusting wax valve 327A and cleaner valve 327B. An air supply valve 327C is associated with the air supply port 318C. Cleaner passage 343 provides cleaner fluid to air passage 339. The air passage 339 leads to the mixing passage 341.

The mixing valve embodiment illustrated in FIGS. 5 and 6 permits cleaning of the spray head. A cleaning fluid is selectively supplied to the cleaner port 319A when the spray head is to be cleaned. For example, cleaning fluid may be provided at the end of a shift or in the evening. The cleaning fluid dissolves excess wax preventing clogging of the spray head and nozzles. Additionally, cleaning fluid may be provided whenever clogging may be a problem.

The present invention provides a compact automated spray system for use on an industrial robot that is maneuverable and can readily be adapted for different spray patterns. The spray head assembly is coupled to a robot arm with an overload protection device that prevents damage due to a possible collision. This is particularly advantageous in view of the application of the present invention to tight spaces and the internal coating of cavities. The present invention has particular application to the automotive industry and the spraying of anticorrosion wax on the inside of car or automobile body cavities. The spray head assembly of the present invention provides rapid change of the many specialized nozzles needed to efficiently coat cavities and to work within tight spaces. The features of the present invention provide additional efficiencies and enhanced quality in the automotive industry. The present invention saves considerable material being sprayed. It has been determined that the present invention uses only one liter of wax per car as opposed to five liters per car using traditional manual spraying. This is particularly advantageous where even small savings have a tremendous impact.

Although the preferred embodiment has been illustrated and described, it will be obvious to those skilled in the art that various modifications may be made without departing from the spirit and scope of this invention.

What is claimed is:

1. A spray head assembly comprising:

an overload protection device adapted to be coupled to an industrial robot;

a hand exchange device coupled to said overload protection device;

a spray head removablely attached to said hand exchange device;

a nozzle attached to said spray head;

a mixing valve coupled so said nozzle;

a cleaner supply port formed within said mixing valve, whereby cleaner fluid may be provided to said nozzle;

a wax supply coupled to said mixing valve;

an air supply coupled to said mixing valve; and whereby cavities are sprayed and damage due to a collision a cleaner supply coupled to said cleaner supply port, is avoided.

2. A spray head assembly comprising:

an overload protection device adapted to be coupled to an industrial robot;

a hand exchange device coupled to said overload protection device;

a spray head body attached to said hand exchange device;

a common nozzle supply coupled to said spray head body; and a plurality of rotatable spray nozzles rotatably attached to said spray head body, each of said plurality of rotatable spray nozzles adapted to be rotated into position and received by said common nozzle supply, whereby different spray patterns may be quickly obtained by selecting one of said plurality of rotatable spray nozzles.

3. A spray head assembly as in claim 2 further comprising:

a bayonet coupling placed on each of said plurality of rotatable spray nozzles.

4. A spray head assembly as in claim 2 further comprising:

a mixing valve body coupled to said common nozzle supply.

5. A spray head assembly as in claim 4 further comprising:

a cleaner valve formed within said mixing valve body, whereby a cleaning fluid may be selectively supplied to said common nozzle supply.

6. A spray head assembly for use with an industrial robot used to coat cavities in automobile manufacturing comprising:

an overload protection device adapted to be coupled to an industrial robot;

a hand exchange device coupled to said overload protection device;

a spray head body attached to said hand exchange device;

a mixing chamber formed in said spray head body;

an air supply coupled to said mixing chamber;

an anticorrosion wax supply coupled to said mixing chamber;

a common nozzle supply coupled to said mixing chamber;

a plurality of rotatable spray nozzles adapted to be received by said common nozzle supply; and a drive coupled to each of said plurality of nozzles and said spray head body, whereby one of said plurality of rotatable spray nozzles is selectively rotated into position and coupled to said common nozzle supply for providing a different spray pattern suited for a particular application.

7. A spray head assembly for use with an industrial robot used to coat cavities in automobile manufacturing as in claim 6 further comprising:

a bayonet coupling associated with each of said plurality of nozzles.

8. A spray head assembly for use with an industrial robot used to coat cavities in automobile manufacturing as in claim 6 further comprising:

a cleaner valve coupled to said mixing chamber, whereby a cleaning fluid may be selectively supplied to said common nozzle supply.

9. A spray head assembly for use with an industrial robot used to coat cavities in automobile manufacturing as in claim 6 wherein:

said plurality of nozzles are radially positioned around said common nozzle supply.

10. A spray head assembly comprising:

an overload protection device adapted to be coupled to an industrial robot;

a hand exchange device coupled to said overload protection device, whereby damage due to a collision is avoided;

a spray head removablely attached to said hand exchange device;

a mixing valve body associated with said spray head, said mixing valve having an air supply port, a wax supply port, and a cleaner supply port;

a wax valve formed within said mixing valve body coupled to the wax supply port and the air supply port;

a cleaner valve formed within said mixing valve body coupled to the cleaner supply port and the air supply port;

a common nozzle supply attached to said mixing valve body; and at least one spray nozzle attached to said common nozzle supply, whereby cavities are sprayed and said nozzle can be selectively cleaned with a cleaner.

11. A spray head assembly as in claim 10 wherein:

said at least one spray nozzle comprises a plurality of nozzles rotatablely attached to said spray head, whereby one of said plurality of nozzles may be selectively rotated into a spraying position onto said common nozzle supply.

12. A spray head assembly as in claim 11 wherein:

said plurality of nozzles are radially positioned around said common nozzle supply.

13. A spray head assembly as in claim 11 further comprising:

a bayonet coupling associated with each of said plurality of nozzles.

14. A spray head assembly for use with an industrial robot used to apply an anticorrosion wax treatment to cavities in automobile manufacturing comprising:

an overload cylinder housing adapted to be coupled to an industrial robot;

an overload cylinder formed within said overload cylinder housing;

an overload piston placed in said overload cylinder;

a locator extending through said overload cylinder housing and positioned to contact said overload piston;

a hand exchange device coupled to said overload piston, said hand exchange device comprising a hand locking piston and hand locking air supply;

a spray head body;

a hand locking receiver attached to said spray head body, whereby said spray head body is attached to said hand exchange device;

a mixing chamber formed in said spray head body;

an air supply coupled to said mixing chamber;

an anticorrosion wax supply coupled to said mixing chamber;

a nozzle sealing cylinder formed in said spray head body adjacent said mixing chamber;

a common nozzle supply coupled to said mixing chamber;

a nozzle sealing piston attached to said common nozzle supply and reciprocating in said nozzle sealing chamber;

a nozzle lock supply formed in said spray head body and coupled to said nozzle sealing cylinder;

a nozzle bayonet lock attached to said spray head body;

a nozzle lock drive coupled to said nozzle lock;

a plurality of rotatable arms attached to said spray head body;

a plurality of arm drives, one of said plurality of arm drives coupled to one of said plurality of rotatable arms, whereby said arm is selectively rotated into a spray position;

a plurality of spray nozzles each adapted to produce a different spray pattern, one of said plurality of spray nozzles attached to each of said plurality of rotatable arms; and a bayonet attached to each of said plurality of spray nozzles and adapted to be received by said nozzle bayonet lock;

whereby one of said plurality of spray nozzles is selectively rotated into the spray position and coupled to said common nozzle supply for providing a different spray pattern suited for a particular application.

15. A spray head assembly for use with an industrial robot used to coat cavities in automobile manufacturing comprising:

a hand exchange device adapted to be coupled to an industrial robot;

a spray head body attached to said hand exchange device;

a mixing chamber formed in said spray head body;

a common nozzle supply coupled to said spray head body and said mixing chamber; and a plurality of rotatable spray nozzles rotatably attached to said spray head body, each of said plurality of rotatable spray nozzles adapted to be rotated into position and received by said common nozzle supply; and a drive coupled to each of said plurality of rotatable spray nozzles and said spray head body, whereby different spray patterns may be quickly obtained by selecting and rotating into position one of said plurality of rotatable spray nozzles onto said common nozzle.

* * * * *